United States Patent [19]

Elrick

[11] Patent Number: 4,462,848

[45] Date of Patent: Jul. 31, 1984

[54] SLURRY CASTING METHOD FOR DOUBLE BASE PROPELLANTS

[75] Inventor: Donald E. Elrick, Rawlings, Md.

[73] Assignee: Hercules Incorporated, Wilmington, Del.

[21] Appl. No.: 342,272

[22] Filed: Jan. 25, 1982

Related U.S. Application Data

[63] Continuation-in-part of Ser. No. 108,268, Dec. 28, 1979, abandoned.

[51] Int. Cl.[3] ..... C06B 45/10

[52] U.S. Cl. ..... 149/19.92; 149/19.8

[58] Field of Search ..... 149/19.8, 19.92

[56] References Cited

U.S. PATENT DOCUMENTS

| | | | |
|---|---|---|---|
| 2,966,403 | 12/1960 | Weil | 149/19.91 |
| 3,106,498 | 10/1963 | Grable | 149/96 |
| 3,702,272 | 11/1972 | McDonnell et al. | 149/19 |
| 3,761,330 | 9/1973 | Lou et al. | 149/21 |
| 3,813,458 | 5/1974 | Simmons | 264/3 C |
| 3,894,894 | 7/1975 | Elrick | 149/19.4 |
| 4,029,529 | 6/1977 | Elrick et al. | 149/19.6 |
| 4,080,411 | 3/1978 | Stanley | 264/3 B |
| 4,097,315 | 6/1978 | Gardner et al. | 149/2 |
| 4,234,364 | 11/1980 | Robinson, Jr. | 149/19.8 |

FOREIGN PATENT DOCUMENTS

| | | | |
|---|---|---|---|
| 1317431 | 5/1973 | United Kingdom . | |
| 2010240 | 6/1979 | United Kingdom | 149/19.8 |

OTHER PUBLICATIONS

*AIAA Journal*, vol. 17, No. 8, Aug. 1979, Article No. 78 981R entitled "Oxidizer Size Distribution Effects on Propellant Combustion", by J. P. Renie, J. A. Condon and J. R. Osborn.

*Primary Examiner*—Edward A. Miller
*Attorney, Agent, or Firm*—Edmund C. Ross, Jr.

[57] ABSTRACT

A slurry casting process is described capable of producing crosslinked double base propellant having improved burning rates and high specific impulse. Such propellants can be formulated to be smokeless. Improved burning rates are achieved by incorporating into a slurry of double base composition, casting powder granules containing 20% to 75% by weight of small particle ammonium perchlorate. The casting powder granules substantially retain their indentity in the cured propellant matrix. The casting powder granules have a high burning rate and are uniformly distributed throughout the propellant. The granules are responsible for increasing the burning rate of the entire crosslinked double base propellant composition of the invention.

3 Claims, No Drawings

SLURRY CASTING METHOD FOR DOUBLE BASE PROPELLANTS

BACKGROUND OF THE INVENTION

This application is a continuation-in-part of U.S. Ser. No. 108,268 filed Dec. 28, 1979, and now abandoned.

This invention relates to slurry cast crosslinked double base propellants having high burning rates, good pressure/rate exponents (n), and producing little or no primary smoke.

PRIOR ART

Large double base propellant motors are presently prepared by two processes, conventional or "in situ" casting and "slurry casting". Each of these processes has advantages depending on the desired properties of the final propellant.

In the "in situ" casting process, casting powder granules comprised of precolloided nitrocellulose are charged to a mold and covered with a casting liquid. The casting powder granules are generally comprised of nitrocellulose, nitroglycerin, ammonium perchlorate, solid nitramine, stastabilizer and ballistic modifiers. The casting liquid is typically comprised of an explosive liquid such as nitroglycerin and a nonexplosive plasticizer such as triacetin or dibutylphthalate. The nitrocellulose portion of the casting powder granules absorbs the casting liquid and swells to form a consolidated mass.

In the present crosslinked double base (XLDB) slurry casting process a pourable slurry of propellant ingredients is prepared and the slurry is cast into a mold and cured. The slurry contains nitrocellulose in solution with other polyols which are crosslinked with polyisocyanates during cure to form a solid propellant. Fine solid oxidizers such as cyclotetramethylenetetranitramine (HMX) are present in the slurry to increase propellant energy and to reinforce the binder system and thereby improve mechanical properties.

Advantages of the slurry casting process over "in situ" methods are relatively short cure times, low processing costs, and adaptability of the process to include highly energetic and sensitive propellant ingredients in the propellant formulation because of relatively mild mixing conditions of the slurry process.

To increase the burning rate of smokeless crosslinked double base propellants prepared by the slurry casting process, ballistic modifiers (e.g., metal compounds such as $Pb_2O_3$ and $SnO_2$ or lead salicylate and lead beta-resorcylate with carbon black) have been added to the propellant matrix during processing. These metal compounds also aid in maintaining a satisfactory pressure/rate exponent (n). Maximum burning rates of about 0.5 in./sec. at 1000 psi with n values of 0.4 to 0.6 are obtained by using relatively large amounts (2–4% based on the weight of the propellant composition) of these ballistic modifiers.

Another method of increasing burning rate of double base crosslinked propellants involves the addition of fine ammonium perchlorate to the propellant matrix. When using this method, however, large quantities of ammonium perchlorate are required to boost burning rate. For example, burning rates of 0.37, 0.35, and 0.54 in./sec., respectively, at 1000 psi were obtained when 0, 5% and 15% of 6 microns ammonium perchlorate was added at the expense of cyclotetramethylenetetranitramine (HMX) in preparation of crosslinked double base propellants that used $Pb_2O_3$, and carbon black as ballistic modifiers. A decrease in ammonium perchlorate particle size does not significantly increase burning rate when ammonium perchlorate is present in moderate concentrations; burning rates were 0.34 and 0.55 in./sec., respectively, at 1000 psi when 5% and 10% of 2 microns ammonium perchlorate was employed in the propellant matrix. Additional increases in burning rate have been obtained by further increases in ammonium perchlorate content but penalties involving increased impact and friction sensitivity and increased secondary smoke formation have been incurred.

U.S. Pat. No. 4,080,411 describes a slurry casting process in which flake casting powder is combined with explosive and nonexplosive plasticizers, a polyglycol adipate-tolylene diisocyanate prepolymer, a stabilizer and a solid nitramine to prepare solid propellants. The flake casting powder described in U.S. Pat. No. 4,080,411 comprises nitrocellulose and is prepared by the solvent process for manufacture of casting powder. In the solvent process a viscous propellant mass comprising nitrocellulose and solvent is pressed into a block and extruded into small strands of propellant of circular cross-section. These small strands are cut into flakes, dried to remove all solvent, glazed with powdered graphite and screened to proper size. In the process described, uniform distribution of ballistic modifiers such as lead beta-resorcylate and lead salicylate in the flake casting powder is readily accomplished by adding such ballistic modifiers to the viscous propellant mass prior to blocking and extrusion.

U.S. Pat. No. 3,813,458 describes a slurry casting process for manufacture of double base propellant in which metallic staple is distributed throughout the propellant to increase the propellant burning rate. The slurry casting process of U.S. Pat. No. 3,813,458 employs both casting powder granules containing ammonium perchlorate and densified (plastisol) nitrocellulose as two sources of nitrocellulose in the propellant. The casting powder granules are primarily included within the slurry to form interstices throughout the slurry which interstices are intended to trap metallic staple in the mixing process to provide uniform distribution of metallic staple throughout the propellant.

SUMMARY OF THE INVENTION

In accordance with this invention, a high specific impulse crosslinked double base propellant having a high burning rate is prepared by a slurry casting process comprising forming a propellant slurry comprising nitrocellulose, explosive plasticizer, curing agents and oxidizers. Casting powder granules are admixed with said slurry, said casting powder granules comprising from about 10% to about 25% by weight based on the weight of the propellant slurry of a double base casting powder composition which contains from about 20% to about 75% by weight of ammonium perchlorate particles having a particle size range of from about 0.5 micron to about 3.0 microns. The resulting propellant composition of this invention is cast and cured. Upon curing, the propellant contains casting powder particles which substantially retain their identity as granules except for a slight absorption of plasticizer and curing agent which results in a slight size increase of the granules and except for a reaction of nitrocellulose in the propellant granule with the curing agents employed in the slurry. Because of the mixing action imparted in preparing the slurry, discrete particles of casting powder having a high burning rate are uniformly dispersed throughout the propellant.

THE CASTING POWDER GRANULES

The casting powder granules which are employed in preparing the propellant composition of this invention are of the double base type (contain nitrocellulose and explosive plasticizer) containing fine particle ammonium perchlorate and are prepared in the usual manner employed in smokeless powder manufacture save that anhydrous conditions and non-solvents for ammonium perchlorate are used to prevent ammonium perchlorate growth during processing. Anhydrous conditions are achieved by removal of trace quantities of moisture in nitrocellulose by azeotropic distillation of nitrocellulose with hexane. Ethyl acetate and hexane are used as processing solvents because they are not solvents for ammonium perchlorate. The amount of fine particle ammonium perchlorate employed is limited by factors involving processability and sensitivity. The casting powder granules can contain from about 20% to about 75% by weight of ammonium perchlorate. The particle size of the ammonium perchlorate is from about 0.5 micron to about 3.0 microns. The maximum amount of ammonium perchlorate solids which can be readily incorporated in the casting powder granules will decrease with decreasing ammonium perchlorate particle size. Thus, up to about 75% by weight of ammonium perchlorate solids having a 2.0 micron particle size can be employed in casting powder granules. Above about 75%, processability becomes extremely difficult. When employing 0.5 micron ammonium perchlorate in a casting powder granule, about 65% by weight of such ammonium perchlorate is the maximum amount which can be processed. The casting powder granules are employed in amounts of from about 10% to about 25% by weight of the propellant composiion.

The casting powder granules are preferably as small as is reasonably practicable, preferably the diameter and length measurements of the casting powder granules being approximately equal. The length and diameter of the casting powder granules may range from about 10 mils to about 50 mils but preferably the length and diameter of the granules are about 30 mils each or less.

The nitrocellulose component of the casting powder granules is preferably nitrocellulose having a nitrogen content of 12.6% N and having a 10–20 second viscosity as measured by a falling ball method (MIL-N-244A) employing a solution comprising 10% nitrocellulose, 10% denatured alcohol and 80% acetone. Other grades of nitrocellulose which can also be used include those with nitrogen contents of 11.8% to 13.4% and viscosities of 18 centipoise (cp) to about 6000 seconds. The viscosity of 13.4% N nitrocellulose is determined using the military specification (MIL-N-244A). Viscosities of other nitrocellulose types are determined using another falling ball method defined in ASTM D 301-56 employing a solution comprising 25% denatured alcohol, 55% toluene and 20% ethyl acetate. The nitrocellulose concentration employed in determining viscosity varies with the type nitrocellulose being tested. Such concentrations are 12.2% for 5 second or higher nitrocellulose, 20% for ½ and ¾ second nitrocellulose and 25% for 18–25 cp, 30–35 cp, ¼ second and ⅜ second nitrocelluloses. Nitrocellulose comprises from about 5% to about 40% by weight of the casting powder granule.

Plasticizers employed in preparations of the casting powder granules are explosive liquids such as nitroglycerin, butanetriol trinitrate, trimetriol trinitrate, and the like. These plasticizers are employed in the casting powder granules in amounts of from about 10% to about 40% by weight.

In addition to ammonium perchlorate, nitrocellulose and plasticizer, additional ingredients such as other polyols, aluminum oxide, ballistic modifiers, graphite linters, aluminum or zirconium staples, carbon black and various stabiizers can be included in the casting powder granules. The concentration ranges of these optional ingredients (weight percent) which can be employed are set forth in Table I below.

TABLE I

| | |
|---|---|
| Polyol (other than Nitrocellulose) | 0–40% |
| $Al_2O_3$ | 0–3% |
| Ballistic Modifiers | 0–4% |
| Graphite Linters or Metal Staples | 0–5% |
| Carbon Black (powder) | 0–0.5% |
| Stabilizers | 1–3.0% |

THE PROPELLANT SLURRY (EXCLUDING CASTING POWDER GRANULES)

The initial slurry of the propellant, i.e., the propellant slurry excluding the casting powder granules, is prepared from nitrocellulose, polyol, curing agent, organic oxidizers, explosive plasticizers, stabilizers and minor amounts of other ingredients. The preferred nitrocellulose is low viscosity nitrocellulose containing 12% N and having a viscosity of 18 cps–25 cps (measured at 25° C. using 25% nitrocellulose and a solvent containing 25% ethanol, 55% toluene and 20% ethyl-acetate) and an approximate intrinsic viscosity of 0.4 deciliters/gram (determined using acetone solvent). Other nitrocellulose types with viscosities of up to 5 seconds can also be used. Viscosity of 5 second nitrocellulose is determined using the above solvent at 12.2% nitrocellulose concentration. Examples of such nitrocellulose are set forth in Table A below:

TABLE A

| Nitrocellulose Type[1] | Approx. Approx. Nitrogen (Wt. %) | Calculated Molecular Weight[2] | Intrisic Viscosity dl/gram[3] | Solution[4] Viscosity (seconds) |
|---|---|---|---|---|
| RS 18–25 cps | | 14,000 | 0.40 | 18–25 cps (12.2% soln.) |
| RS ¼ sec | | 22,000 | 0.55 | 4–5 sec. (25% soln.) |
| RS ½ sec | 11.8%–12.2% | 33,000 | 0.72 | 3–4 sec. (20% soln.) |
| RS ¾ sec | | 42,000 | 0.88 | 6–8sec. (20% soln.) |

TABLE A-continued

| Nitrocellulose Type[1] | Approx. Approx. Nitrogen (Wt. %) | Calculated Molecular Weight[2] | Intrisic Viscosity dl/gram[3] | Solution[4] Viscosity (seconds) |
|---|---|---|---|---|
| RS 5-6 sec | | 68,000 | 1.47 | 5-6.5 sec. (12.2% soln.) |

[1]RS and SS type designation for nitrocellulose specifically refers to a designation used by Hercules Incorporated for nitrocellulose sold by Hercules Incorporated. An "RS " type nitrocellulose indicates solubility of the nitrocellulose in esters such as ethyl and butyl acetates, in ketones and glycol ethers. See "Nitrocellulose Properties and Uses", Hercules Powder Company, (1955), pages 10, 11, 12.
[2]Molecular weight calculated from intrinsic viscosity values. See article entitled "Intrinsic Viscosity of Nitrocellulose, C. H. Lindsley and M. B. Frank, Industrial and Engineering Chemistry, November 1953, pp. 2491-2497.
[3]Intrinsic Viscosity determined using acetone solvent.
[4]Solution viscosity is measured by the Falling Ball Method using as the solvent a mixture comprising by weight, 20% ethyl acetate, 25% denatured ethyl alcohol and 55% toluene.

A range of nitrocellulose for the initial slurry of the propellant is defined by nitrocellulose having 12% nitrogen by weight and an approximate intrinsic viscosity of between 0.4 and 1.5 deciliters/gram.

Polyols that can be employed in the initial slurry of the propellant are polyester polyols, polyethylene glycols, poly(oxyethylene-butylene) glycols, and polycaprolactones. The polyols employed generally have a molecular weight range of from about 2000 to about 6000 and a hydroxyl functionality of from about 2 to about 3. Polyester diols which can be employed can be prepared by reaction of monomeric dialcohols such as ethylene glycol, diethylene glycol, propylene glycol, butylene glycol, hexamethylene glycol, mixtures thereof and the like, with dibasic acids such as adipic acid, succinic acid, azelaic acid, sebacic acid, oxadibutyric acid, mixtures thereof, and the like. Polyglycol adipate is a preferred polyol to be employed with nitrocellulose in the initial slurry of the propellant.

The combination of nitrocellulose and polyols comprises from about 5% to about 12% by weight of the initial propellant slurry. The nitrocellulose content can be from 0% to about 4% and the polyol from about 1% to about 12%. The preferred initial slurry contains from about 0.4% to 2.0% nitrocellulose and from about 4% to about 7% polyol, preferably polyglycol adipate.

Plasticizers employed in preparations of the initial slurry are explosive liquids such as nitroglycerin, butanetroil trinitrate, trimetriol trinitrate, and the like. These plasticizers are employed in the initial slurry in amounts of from about 5% to about 50% by weight.

Polyfunctional isocyanates are employed as curing agents for the nitrocellulose and polyols which form the binder of the propellant compositions of this invention. The polyfunctional isocyanates which can be employed have an NCO functionality of two or more. Illustrative polyfunctional isocyanates which can be employed include tolylene diisocyanate, hexamethylene diisocyanate, 3-isocyanatomethyl-3,5,5-trimethylcyclohexaneisocyanate, isocyanates having a functionality of 3 or more prepared by reaction of diisocyanates such as hexamethylene diisocyanates and water, and the like. Curing agents are generally employed in amounts of from about 0.8% to about 2% based on the weight of the initial slurry, but greater and smaller concentrations can be employed. In addition to the polyfunctional isocyanate curing agent, a curing catalyst is preferably employed to speed the rate of cure of the propellant by catalyzing the reaction of isocyanate groups with hydroxyl groups. Illustrative curing catalysts include triphenyl bismuth (TPB), dibutyl tin diacetate (DBTDA), and dibutyl tin diluarate.

Organic oxidizer solids can be employed in the propellant slurry. Illustrative organic oxidizers include cyclotetramethylenetetranitramine (HMX); cyclotrimethylenetrinitramine (RDX); solid nitramines such as 2,5-dinitrazahexane and solid nitro compounds such as hexanitrostilbene and nitroguanidine. The solid organic oxidizers employed must have a small particle size so that they can be dispersed readily through the propellant mass and remain uniformly dispersed after mixing has been completed. Organic oxidizers comprise from about 30% to about 50% by weight of the initial slurry, but greater and smaller concentrations can be employed.

THE EXAMPLES

The following examples further illustrate this invention. In the examples and throughout this specification, percentages are by weight unless specified otherwise.

EXAMPLES 1-4

Casting powder granules employed in the slurry process of this invention are prepared as follows:

Hexane-wet nitrocellulose, nitroglycerin, ammonium perchlorate, stabilizer, ultrafine carbon black and ½ inch length graphite linters are mixed in a sigma blade mixer using a mixture of hexane and ethyl acetate as processing solvents in sufficient quantities to produce a propellant dough. The resulting dough is pressed through 30 mil dies to obtain strands which are cut into 27 mil length casting powder. Residual solvents are removed by oven drying to obtain casting powder, composition A. Composition B is prepared in the same manner as composition A but is contains $Al_2O_3$. The casting powder compositions are set forth in Table II below.

TABLE II

| Composition (%) | Casting Powder A | Casting Powder B |
|---|---|---|
| Nitrocellulose (12.6%, 10 sec.) | 29.00 | 28.00 |
| Nitroglycerin | 25.24 | 25.24 |
| Stabilizer | 2.76 | 2.76 |
| Ammonium perchlorate (2μ) | 40.00 | 40.00 |
| Graphite linters[(a)] | 3.00 | 3.00 |
| $Al_2O_3$ | 0 | 1.00 |

[(a)]Graphite linters, nominal diameter of 10μ, Type HMS manufactured by Hercules Incorporated.

Slurries containing casting powder granules of compositions A and B are prepared by forming an initial slurry by mixing of ingredients, i.e., a lacquer containing 18-25 cp nitrocellulose and nitroglycerin, additional nitroglycerin, stabilizers, a polyglycol adipate, small particle sized HMX and cure catalysts (TPB and DBTDA) at reduced pressure (<15 mm Hg) adding hexamethylene diisocyanate curing agent and then adding casting powder granules to the slurry and mixing again at the reduced pressure of <15 mm Hg. Additional ballistic modifiers are also added to the propellant slurry in preparing the propellant composition of Example 2. The initial propellant slurries, i.e., prior to addition of the casting powder granules have the compositions set forth in Table III:

TABLE III

| Example No. Casting Powder | 1 Comp. "A" | 2 Comp. "A" | 3 Comp. "B" | 4 Comp. "A" |
|---|---|---|---|---|
| Slurry Composition (parts) | | | | |
| Nitrocellulose, 12% N (18–25 cp) | 1.29 | 1.29 | 1.29 | 1.29 |
| Nitroglycerin | 35.92 | 35.92 | 35.92 | 35.92 |
| Polyglycol adipate | 5.46 | 5.38 | 5.51 | 5.23 |
| Stabilizer-1 | 0.86 | 0.86 | 0.86 | 0.84 |
| Stabilizer-2 | 0.36 | 0.36 | 0.36 | 0.34 |
| Hexamethylene diisocyanate | 0.99 | 1.07 | 0.94 | 0.81 |
| HMX (5 microns) | 40.12 | 38.25 | 40.12 | 37.76 |
| $SnO_2$ | — | 0.85 | — | — |
| $Pb_2O_3$ | — | 0.85 | — | — |
| Carbon black[a] | — | 0.17 | — | — |
| TPB (added)[b] | 0.02 | 0.02 | 0.02 | 0.02 |
| DBTDA X10[4][c] | 8 | 8 | 8 | 7 |

[a]Ultrafine carbon black having a surface area of 1125 $m^2$/gram.
[b]TPB is triphenyl bismuth.
[c]DBTDA is dibutyl tin diacetate.

The resulting slurries to which the casting powder has been added are each mixed for 15–20 minutes at 100°–110° F. at reduced pressure. The propellants are then cast into molds and cured for 4 days at 50°–70° F. and 7 days at 120° F. The initial low temperature cure is used to permit some exchange of plasticizers between slurry and casting powder and to permit some absorption of curing agent into the casting powder while the 120° F. cure is used primarily to allow curing agent to react with functional hydroxyl groups in nitrocellulose and polyglycol adipate and thereby solidify the propellant. The composition of each of the resulting propellants is given in Table IV.

TABLE IV

| Composition | Ex. 1 | Ex. 2 | Ex. 3 | Ex. 4 |
|---|---|---|---|---|
| Nitrocellulose (12.6% N, 10 sec.) | 4.35 | 4.35 | 4.20 | 5.80 |
| Nitrocellulose (18–25 cp) | 1.29 | 1.29 | 1.29 | 1.22 |
| Polyglycol adipate[a] | 0 | 5.38 | 0 | 0 |
| Polyglycol adipate[b] | 5.46 | 0 | 5.51 | 5.23 |
| Nitroglycerin | 39.70 | 39.70 | 39.70 | 38.85 |
| Stabilizer | 0.55 | 0.55 | 0.55 | 0.59 |
| Stabilizer | 0.94 | 0.94 | 0.94 | 0.91 |
| Stabilizer | 0.15 | 0.15 | 0.15 | 0.20 |
| Hexamethylene diisocyanate | 0.99 | 1.07 | 0.94 | 0.84 |
| HMX (5 microns) | 40.12 | 38.25 | 40.12 | 37.76 |
| Ammonium perchlorate (2 microns) | 6.00 | 6.00 | 6.00 | 8.00 |
| Graphite Linters[c] | 0.45 | 0.45 | 0.45 | 0.60 |
| Carbon Black[d] | 0 | 0.17 | 0 | 0 |
| $SnO_2$ | 0 | 0.85 | 0 | 0 |
| $Pb_2O_3$ | 0 | 0.85 | 0 | 0 |

TABLE IV-continued

| Composition | Ex. 1 | Ex. 2 | Ex. 3 | Ex. 4 |
|---|---|---|---|---|
| $Al_2O_3$ (0.1 micron) | 0 | 0 | 0.15 | 0 |

[a]Polyglycol adipate, hydroxyl functionality of about 2.7, molecular weight of about 2400.
[b]Polyglycol adipate, hydroxyl functionality of about 2.7, molecular weight of about 4,000.
[c]See footnote [a], Table II.
[d]Ultrafine carbon black having a surface area of about 1125 $m^2$/gram.

The propellant compositions of Examples 1–4 were evaluated for rheological properties, ballistic data and mechanical properties. Results of these evaluation tests are set forth in Table V.

TABLE V

| | Ex. 1 | Ex. 2 | Ex. 3 | Ex. 4 |
|---|---|---|---|---|
| Rheological Properties | | | | |
| Viscosity (kp)[a] | 3.7 | 3.4 | 4.0 | 4.2 |
| n'[b] | 0.39 | 0.45 | 0.47 | 0.56 |
| Pot Life (hours) | 4+ | [c] | [c] | 5 |
| Strand Ballistic Data | | | | |
| $r_{1000}$ (in./sec.) | 0.87 | 0.95 | 0.94 | 1.05 |
| n from 500–1000 psi | 0.65 | 0.61 | 0.77 | 0.69 |
| n from 1000–1500 psi | 0.65 | 0.61 | 0.50 | 0.69 |
| n from 1500–2000 psi | 0.78 | 0.61 | — | 0.69 |
| Mechanical Properties at 77° F. at 0.74 in./in./min. (Instron Tester) | | | | |
| Tensile Strength (psi) | 76 | 88 | 78 | 92 |
| Elongation (%) | 26 | 42 | 39 | 30 |
| Modulus (psi) | 440 | 360 | 340 | 540 |

[a]Viscosity at 32° C. at 0.57 $sec.^{-1}$
[b]Flow behavior index (dimensionless)
[c]Not determined Of the foregoing examples, the propellants of Examples 1 and 4 illustrate preferred embodiments because their compositions do not contain metal oxides as do the propellants of Examples 2 and 3. The compositions of Examples 1, 3 and 4 do not produce primary smoke upon combustion. Primary smoke is visible because of the presence of particles of metal reaction products in the propellant exhaust. Lead compounds which further augment the burning rate of the propellant compositions of this invention react during combustion forming lead chloride which augments smoke visibility. In order to maintain smokelessness, metals are preferably omitted from the propellant compositions of this invention or employed in small amounts, say of less than 2% by weight of the propellant composition.

Secondary smoke is a contrail of visible water crystals or droplets which form as a result of the hygroscopic action of hydrogen chloride in the exhaust with water vapor. The visibility of secondary smoke is increased by decreasing temperature or by increasing relative humidity. Propellants containing ammonium perchlorate produce some secondary smoke. The propellants of this invention exhibit high burning rates but employ comparatively low amounts of ammonium perchlorate and, therefore, produce low amounts of secondary smoke. Composite propellants are comprised almost entirely of ammonium perchlorate and secondary smoke evolution of composite propellants is high.

The propellant compositions of this invention have a relatively high specific impulse largely because of the presence of a relatively large amount of solid oxidizer, such as cyclotetramethylene tetranitramine (HMX) in the propellant. High burning rates can be obtained despite the presence of the large amounts of the solid organic oxidizers such as HMX which tend to depress the burning rate. Burning rate is high because of the relatively high concentration of ammonium perchlorate in discrete areas which are uniformly distributed throughout the propellant.

Propellants of this invention have advantages over propellants prepared by a slurry casting process containing flake casting powder. Burning rates are higher and pot life is longer for propellants of this invention. Propellant slurries of this invention can have a pot life in excess of five hours compared to a 20–60 minute pot life for slurries containing flake casting powder.

What I claim and desire to protect by Letters Patent is:

1. A process for preparation of slurry cast propellant compositions which exhibit improved burning rates, said process comprising (a) preparing an initial propellant slurry comprising a casting solvent, low viscosity nitrocellulose containing 12% nitrogen by weight, a polyol having a molecular weight of from about 2000 to about 6000 and a hydroxyl functionality of from about 2 to about 3, a polyfunctional isocyanate crosslinking agent, and solid oxidizing agents selected from organic nitramines and organic nitro compounds; (b) admixing double base casting powder granules with said propellant slurry, said casting powder granules comprising from about 10% to about 25% by weight, based on the weight of the resulting propellant slurry, said casting powder granules containing from about 20% to about 75% ammonium perchlorate having a particle size range of from about 0.5 micron to about 3.0 microns provided that if about 50% of the ammonium perchlorate in said granules has a particle size of about 0.5 micron the total perchlorate content of said casting powder shall not exceed 65% by weight; (c) casting the slurry of step (b), and (d) curing said slurry forming a crosslinked double base propellant composition.

2. The process of claim 1 in which the initial propellant slurry of step (a) comprises from about 5% to about 50% of nitroglycerin, from about 5% to about 12% of nitrocellulose containing 12% N having a viscosity of 18–25 centipoises and polyglycol adipate, from about 0.8% to about 2.0% of crosslinking agent, about from about 30% to about 50% of solid organic oxidizer.

3. The process of claim 2 in which the casting powder granules of step (b) comprises from about 20% to about 75% of ammonium perchlorate, from about 5% to about 40% of nitro cellulose containing 12.6% N and having a viscosity of 10–20 seconds, and from about 10% to about 40% of explosive plasticizer.

* * * * *